US007410164B2

(12) United States Patent
Koide et al.

(10) Patent No.: US 7,410,164 B2
(45) Date of Patent: Aug. 12, 2008

(54) DISCHARGING DEVICE AND INK JET PRINTER

(75) Inventors: Shohei Koide, Aichi-ken (JP); Yuji Koga, Aichi-ken (JP); Yusaku Watanabe, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 259 days.

(21) Appl. No.: 11/288,359

(22) Filed: Nov. 29, 2005

(65) Prior Publication Data

US 2006/0114280 A1 Jun. 1, 2006

(30) Foreign Application Priority Data

Nov. 29, 2004 (JP) ..... 2004-344019

(51) Int. Cl.
*B65H 31/04* (2006.01)

(52) U.S. Cl. ..... 271/213; 271/202; 271/223

(58) Field of Classification Search ..... 271/171, 271/176, 202, 207, 213, 220, 223; 347/104; 399/405

See application file for complete search history.

(56) References Cited

U.S. PATENT DOCUMENTS

| | | | | |
|---|---|---|---|---|
| 5,743,518 | A * | 4/1998 | Takashimizu et al. | 271/4.1 |
| 6,190,116 | B1 * | 2/2001 | Asada | 414/790.7 |
| 6,659,454 | B1 * | 12/2003 | Smith et al. | 271/213 |
| 6,890,071 | B2 * | 5/2005 | Khormaei et al. | 347/104 |
| 6,991,331 | B2 * | 1/2006 | Kagami et al. | 347/108 |
| 7,059,597 | B2 * | 6/2006 | Shirakura et al. | 271/171 |
| 7,070,350 | B2 * | 7/2006 | Inokuchi et al. | 400/680 |
| 2003/0081101 | A1 * | 5/2003 | Khormaei et al. | 347/104 |
| 2003/0103127 | A1 * | 6/2003 | Khormaei et al. | 347/104 |
| 2004/0017460 | A1 * | 1/2004 | Kagami et al. | 347/104 |
| 2004/0056413 | A1 * | 3/2004 | Shirakura et al. | 271/145 |
| 2005/0052517 | A1 * | 3/2005 | Fujioka et al. | 347/104 |
| 2005/0206071 | A1 * | 9/2005 | Suzuki et al. | 271/207 |
| 2006/0050127 | A1 * | 3/2006 | Noda et al. | 347/104 |
| 2006/0098072 | A1 * | 5/2006 | Takeuchi et al. | 347/104 |
| 2006/0203068 | A1 * | 9/2006 | Nagata et al. | 347/104 |

FOREIGN PATENT DOCUMENTS

| | | |
|---|---|---|
| JP | 5 162914 | 6/1993 |
| JP | 6 9066 | 1/1994 |
| JP | 6 64815 | 3/1994 |

(Continued)

*Primary Examiner*—Patrick Mackey
*Assistant Examiner*—Michael C McCullough
(74) *Attorney, Agent, or Firm*—Baker Botts L.L.P.

(57) ABSTRACT

When a print process is started, discharge speed of recording papers is first set to a first discharge speed set based on the case in which a recording paper receiving unit for placing recording papers is in a reference state. Then, when a record instruction is given for starting a process of recording images onto recording papers, it is determined whether or not the recording paper receiving unit is in the reference state. If it is determined that the recording paper receiving unit is in an extended state in which the recording paper receiving unit is extended from the reference state, the discharge speed of the recording papers is set to a second discharge speed that is faster than the first discharge speed. Then, following a paper feed operation and an image record operation, the recording papers are discharged according to the set discharge speed.

13 Claims, 12 Drawing Sheets

FOREIGN PATENT DOCUMENTS

| | | |
|---|---|---|
| JP | 8 143203 | 6/1996 |
| JP | 9 288392 | 11/1997 |
| JP | 10 167547 | 6/1998 |
| JP | 2002 3042 | 1/2002 |
| JP | 2002 356260 | 12/2002 |
| JP | 2003 201054 | 7/2003 |
| JP | 2004 109289 | 4/2004 |

* cited by examiner

DISCHARGING DEVICE AND INK JET PRINTER

CROSS-REFERENCE TO RELATED APPLICATIONS

This Nonprovisional application claims priority under 35 U.S.C. §119 (a) on Patent Application No. 2004-344019 filed in Japan on Nov. 29, 2004, the entire contents of which are hereby incorporated by reference.

BACKGROUND

The present relates to a discharging device for discharging a conveyed object to a conveyed object receiving means on which the conveyed object can be placed, and an ink jet printer provided with such a discharging device.

Conventionally, a discharging device for discharging a conveyed object to a conveyed object receiving unit on which the conveyed object can be placed is known.

For instance, a recording device such as an ink jet printer or a laser printer, etc. is such configured to perform: a paper feed operation for feeding recording papers one by one from a paper feed tray on which the recording papers as an object to be conveyed are laminated (stacked) to a recording unit, a record operation for recording images on a recording paper in the recording unit, and a discharge operation for discharging the recording paper on which images were recorded in the recording unit to a recording paper receiving unit that includes a paper discharge tray on which the recording paper can be placed.

There are some paper discharge trays such configured that, even when papers of large size are discharged, the recording paper receiving unit is extendable so that the papers can be placed safely.

For instance, Japanese Patent Application Laid-Open No. H10-167547 (1998) discloses the configuration in which a paper discharge tray for placing discharged recording papers is partially depressed and a supplementary tray that can be housed in the depression is rotatably provided, thereby making it switchable between the state in which the supplementary tray is housed in the depression of the paper discharge tray and the state in which the supplementary tray projects from the paper discharge tray.

For another example, Japanese Patent Application Laid-Open No. 2003-201054 discloses the configuration in which a paper discharge tray for placing discharged recording papers is partially depressed, wherein an extendable tray that is rotatably moved with respect to the paper discharge tray and a supplementary tray that is rotatably moved with respect to the extendable tray are provided so as to be housed in the depression, whereby the extendable tray can be opened to the paper discharge tray, and the supplementary tray can be further opened to the extendable tray, which thus enables the recording paper receiving unit to be widely extended.

SUMMARY

Incidentally, as the speed of conveying (discharge speed) recording papers when discharging them to the paper discharge tray becomes faster, the time required for the discharge operation of recording papers can be reduced, thus enabling the time for the record operation of images onto recording papers (the paper feed operation, the record operation, and the discharge operation) to be reduced. Therefore, it is preferable to make the discharge speed of the recording papers as fast as possible in terms of reduction of time required for recording images onto the recording papers.

There is a trend, however, that the faster the discharge speed of the recording papers is, the more alignment performance of the recording paper degrades, which causes the recording papers to fall from the paper discharge tray. In particular, for a printer having a facsimile function, if a recording paper drops from a paper discharge tray, the missing recording paper might cause a trouble. Although use of a larger paper discharge tray can prevent such the problem of the recording papers' falling, an increase in the size of the paper discharge tray is not preferable because it makes the equipment itself become larger.

On the one hand, as described above, even though use of the equipment configured so as to extend the recording paper receiving unit including the paper discharge tray could prevent the equipment itself from becoming larger, in such configuration, if the discharge speed of the recording papers was set based on the state that the recording paper receiving unit is extended, there would arise a problem that recording papers might drop if the recording paper receiving unit was not extended. Thus, the discharge speed of recording papers had to be set lower based on the state that the recording paper receiving unit is not extended, which hindered adequate reduction of time required for the discharge operation of recording paper.

It is therefore an object to provide a discharging device and an ink jet printer that can reduce time required for discharge of a conveyed object.

A discharging device according to a first aspect for achieving the object described above comprises conveyed object receiving unit having a supplementary conveyed object receiving unit, on which a conveyed object can be placed, and being configured so as to be changed to an extended state that the supplementary conveyed is object receiving unit is extended, and discharging unit for discharging a conveyed object which has been conveyed, to the conveyed object receiving unit. In addition, as the conveyed object receiving unit, the configuration may be employed that can change the state of the conveyed object receiving unit by varying a positional relationship between a member mainly formed of the base of the conveyed object receiving unit and a member of the supplementary conveyed object receiving unit, or the configuration may be employed in which the extensible structure allows the conveyed object receiving unit to be changed.

The discharging device further includes a controller which determines the state of the conveyed object receiving unit and accelerates the discharge speed of the conveyed object discharged by the discharging unit if the state is extended state.

In other words, the discharging device discharges a conveyed object to the conveyed object receiving unit, and is configured to discharge the conveyed object faster if the conveyed object receiving unit is in the extended state.

Therefore, the present discharging device can reduce time required for discharge of a conveyed object, while preventing the conveyed object from being dropped from the conveyed object receiving unit. In other words, in the configuration in which a conveyed object is discharged at constant discharge speed irrespective of the state of the conveyed object receiving unit, there could arise the problem that if the discharge speed is set based on the extended state of the conveyed object receiving unit, the conveyed object might drop unless the conveyed object receiving unit is in the extended state. Hence, the discharge speed should be set based on the state that the conveyed object receiving unit is not in the extended state. In contrast, the present discharging device can reduce the time required for discharge of the conveyed object by accelerating the discharge speed while the conveyed object receiving unit is in the extended state.

Although the present discharging device can be employed for various applications to discharge a conveyed object (for instance, recording devices such as an ink jet printer, laser printer, etc.), it is effective if it is configured as the ink jet printer according to a second aspect.

In other words, the ink jet printer according to the second aspect includes the discharging device according to the first aspect and is configured to discharge a recording medium on which an image has been recorded, as the conveyed object. The term recording medium used herein refers to a medium on which images (including characters or symbols, etc.) can be recorded by ejecting ink and includes a sheet object such as a recording paper, for instance.

Generally, an ink jet printer is configured to perform a discharge operation of a recording medium when an operation of recording images in the recording medium completes, wherein the lower the percentage of images to be recorded in the recording medium is, the shorter the time required for the operation of recording images is. Accordingly, compared with the laser printer which takes certain time for the operation of recording images irrespective of the percentage of images to be recorded in the recording medium, the reduction of the time for discharge operation of a conveyed object is more effective in the ink jet printer (the effect of reducing the time of the operation of recording images in a recording medium). Therefore, the present ink jet printer can effectively reduce the time for the operation of recording images in the recording medium.

The above and further objects and features will more fully be apparent from the following detailed description with accompanying drawings.

DETAILED DESCRIPTION OF THE EXEMPLARY EMBODIMENTS

In the following, the present embodiment is described using the drawings.

Figure 1:
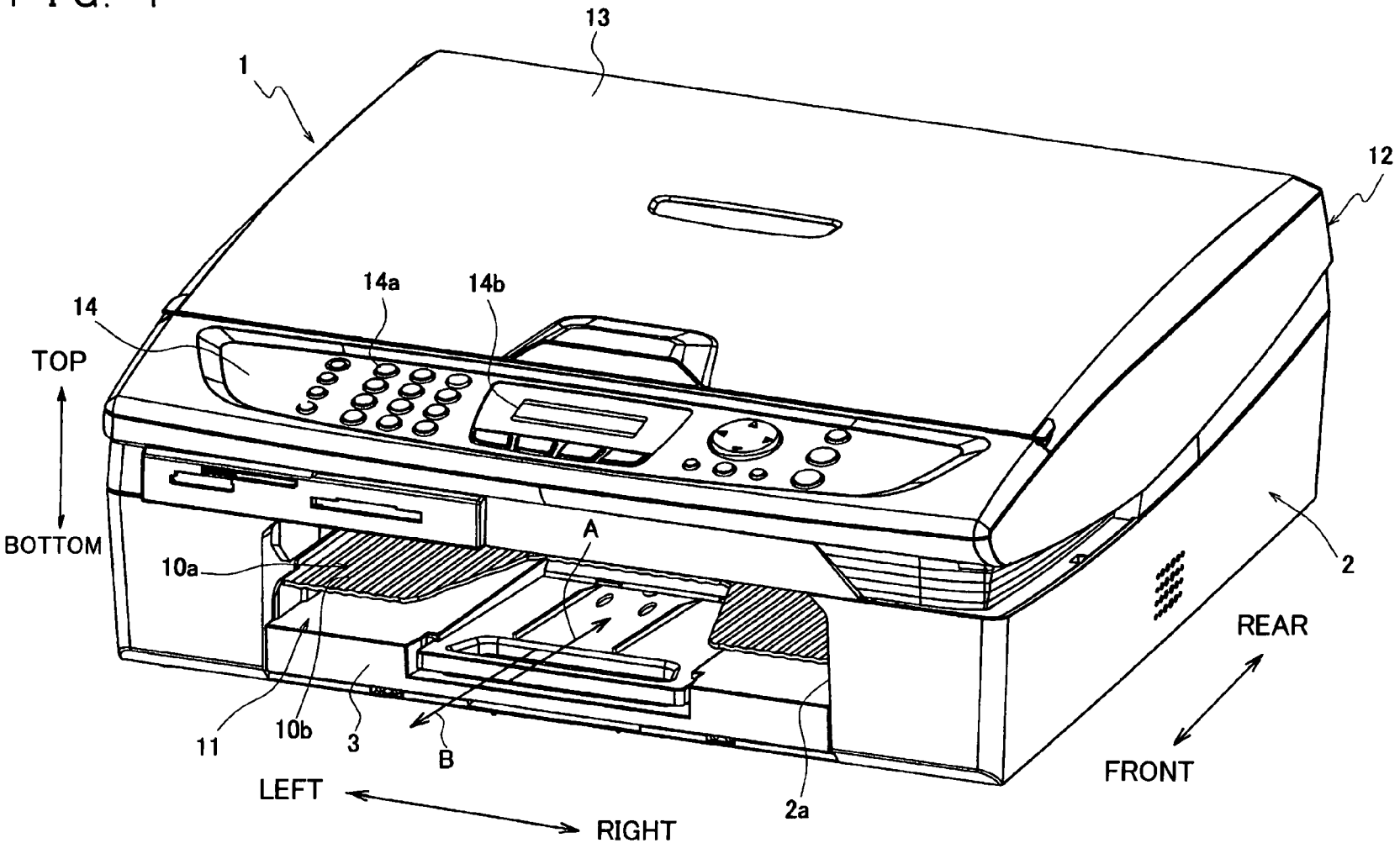
FIG. 1 is a perspective view of a multi-functional device of the embodiment.

FIG. 1 is a perspective view of a multi-functional device (MFD: Multi Function Device) 1 of the embodiment, and FIG. 2 is a side sectional view thereof.

The multi-functional device 1 has a printer function, a copy function and a scanner function and a facsimile function. As shown in FIGS. 1 and 2, an image reading device 12 used for reading a document is provided on the top of a housing 2 made of a synthetic resin.

The image reading device 12 is configured in a vertically openable and rotatable manner around a pivot (not shown) provided at the left end of the image reading device 12, with respect to a housing 2. Further, a document cover body 13 which covers the upper face of the image reading device 12 is placed in a vertically openable and rotatable manner around a pivot 12*a* (see FIG. 2) provided at the rear end of the document cover body 13, with respect to the image reading device 12.

Figure 2:
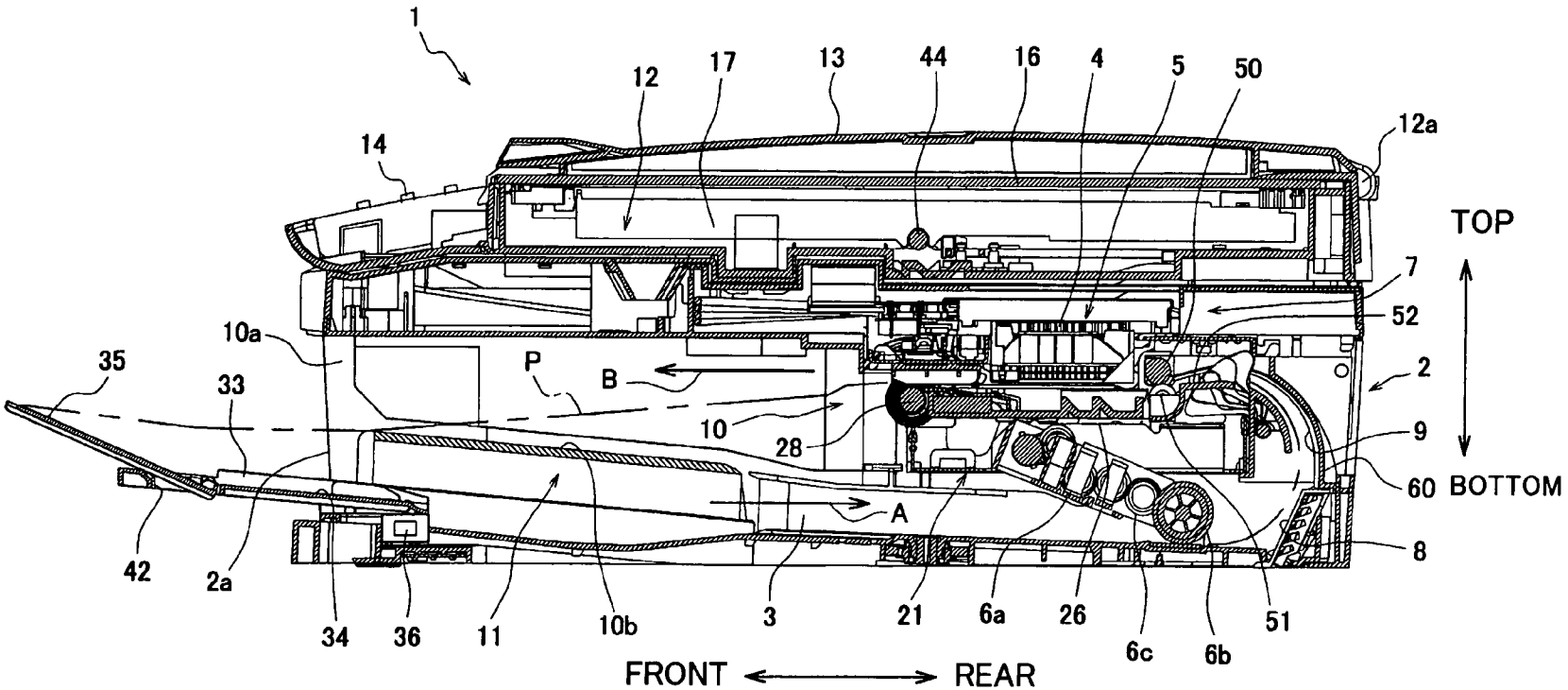
FIG. 2 is a side sectional view of the multi-functional device of the embodiment.

As shown in FIG. 2, a glass plate 16 for placement is provided for placing a document to be read after opening of the upper side of the document cover body 13 on the upper face of the image reading device 12. Under the glass plate 16 for placement, a contact image scanner (CIS: Contact Image Sensor) 17 for document reading is provided along a guide shaft 44 extending in a direction orthogonal to paper of FIG. 2 (main-scanning direction, horizontal direction) so as to reciprocate.

In addition, as shown in FIGS. 1 and 2, ahead of the image reading device 12 is provided an operational panel unit 14 including an operational button group 14*a* for performing an input operation and a liquid crystal display unit (LCD) 14*b* for displaying various information.

In the meantime, a paper feed unit 11 for feeding recoding paper P as the recording medium (an object to be conveyed) is provided on the bottom of the housing 2. In the paper feed unit 11, a paper feed cassette 3 for housing the recording paper P in a laminated (stacked) state is detachably provided in a cross direction with respect to the housing 2 via an opening 2*a* formed on the front side of the housing 2. In this embodiment, the paper feed cassette 3 is configured to be capable of housing a plurality of laminated (stacked) sheets of the recording paper P of an A-4 size, a letter size, a regal size, a postcard size, or the like, with the short side (width) thereof extending in a direction (main-scanning direction, horizontal direction) orthogonal to the paper feeding direction (sub-scanning direction, cross direction, direction of the arrow A).

As shown in FIG. 2, an inclined separation plate 8 for separating recording paper is arranged on the back side (rear end side) of the paper feed cassette 3. The inclined separation plate 8 is formed in a projection curved shape as viewed from a plane so as to protrude in the midsection in the width direction (horizontal direction) of the recording paper P, and gradually retract toward both the left and right ends in the width direction of the recording paper P. A saw-tooth elastic separation pad 8a (refer to FIGS. 5, 6A, 6B 7A and 7B) is provided in the midsection in the width direction of the recording paper P for promoting separation by abutting against the head of the recording paper P.

Further, a rear anchor unit of a paper feed arm 6*a* for feeding the recording paper P from the paper feed cassette 3 is mounted in the paper feed unit 11 on the housing 2 side so as to rotate vertically. A rotation driving force is transmitted from an LF (conveyance) motor 132 (see FIG. 9) to a paper feed roller 6*b* provided at the head of the paper feed arm 6*a* by a gear transmission mechanism 6*c* provided in the paper feed arm 6*a*. Each sheet of the recording paper P stacked in the paper feed cassette 3 is separately conveyed with use of the paper feed roller 6*b* and the foregoing elastic separation pad 8*a* of the inclined separation plate 8. In this manner, each sheet of the recording paper P separated so as to proceed along the paper feeding direction (the direction of the arrow A) is conveyed to a recording unit 7 provided above (on a position higher than) the paper feed cassette 3 via a feeding path 9 including a sidewise, U-shaped pass formed in a space between a first conveyance path body 60 and a second conveyance path body 52.

Figure 3:
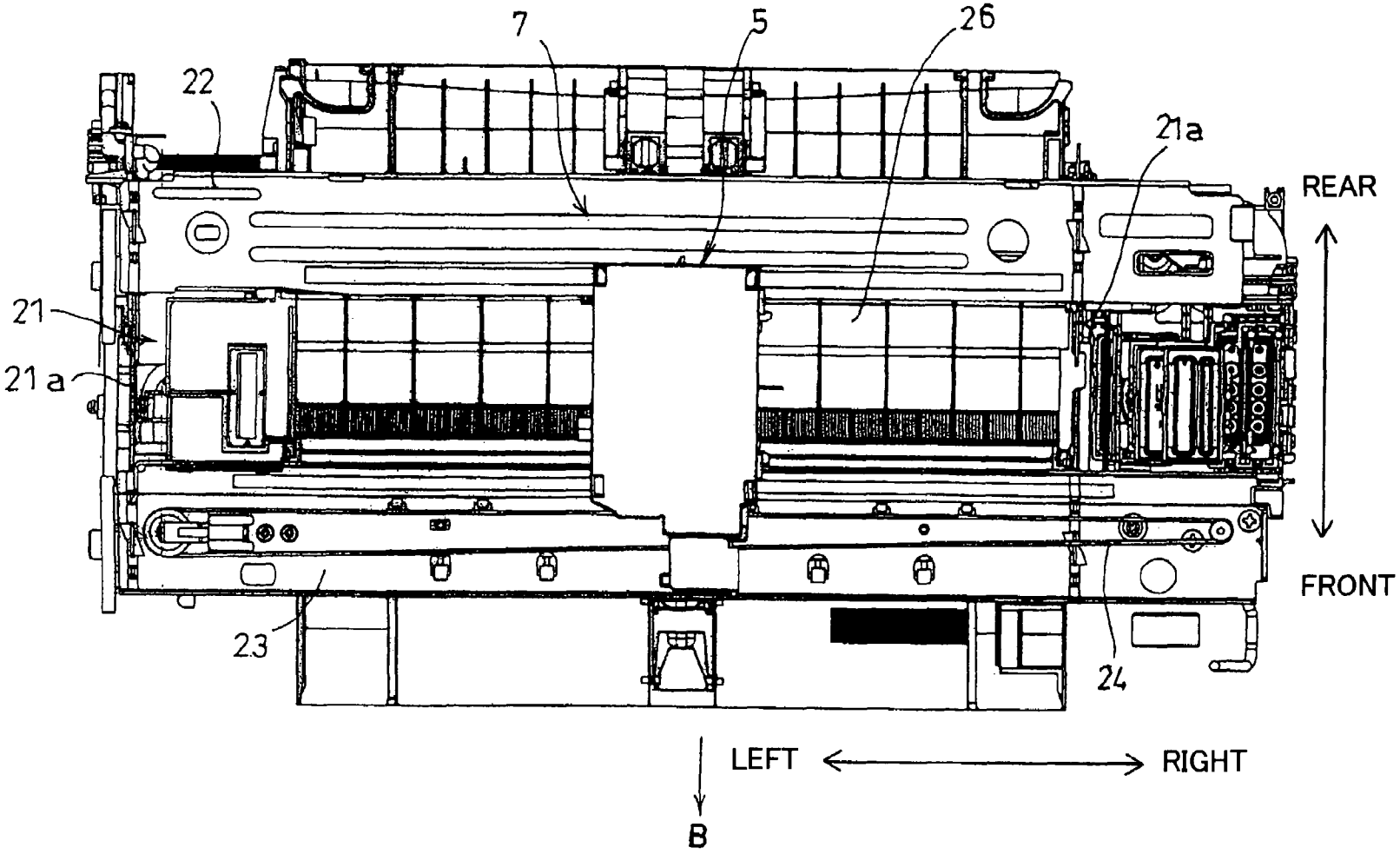
FIG. 3 is a partial plan view of the multi-functional device with an image reading device removed.

FIG. 3 is a partial plan view of the multi-functional device 1 with the image reading device 12 removed.

As shown in FIG. 3, the recording unit 7 is provided between a main frame 21 formed in an upwardly opened box shape and a first guide member 22 and a second guide member 23 in horizontally platy shape which are supported by a pair of left and right side plates 21a and extend in the horizontal direction (main-scanning direction). The recording unit 7 comprises an inkjet-type recording head 4 (see FIG. 2) for recording an image on the recording paper P by ejecting ink from the lower face thereof, and a carriage 5 equipped with the recording head 4.

The carriage 5 is slidably supported astride the first guide member 22 and the second guide member 23 respectively arranged on the upstream side and on the downstream side in the paper discharging direction (direction of the arrow B), and the carriage 5 is provided so as to reciprocate in the horizontal direction. In order to reciprocate the carriage 5, on the upper face of the second guide member 23 arranged on the downstream side in the paper discharging direction (the direction of the arrow B), a timing belt 24 is wound so as to extend in the main-scanning direction (horizontal direction), and a CR (carriage) motor 131 (see FIG. 9) for driving the timing belt 24 is fixed to the lower face of the second guide member 23.

Meanwhile, on a recording unit 7, below the lower face of the recording head 4 in the carriage 5, a flat platen 26, extending in the horizontal direction while opposed to the recording head 4, is fixed to the main frame 21 between the two guide members 22, 23.

As shown in FIG. 2, a drive roller 50 and a nip roller 51 are arranged on the upstream side of the platen 26 in the paper discharging direction (the direction of the arrow B). The drive roller 50 serves as a conveyance (resist) roller for conveying the recording paper P to the lower face of the recording head 4. The nip roller 51 is placed below the drive roller 50 while opposed thereto. Further, a paper discharge roller 28 and a spur roller (not shown) are arranged on the downstream side of the platen 26 in the paper discharging direction (the direction of the arrow B). The paper discharge roller 28 is driven so as to convey the recording paper P, is having been conveyed via the recording unit 7, to a paper discharge unit 10 along the paper discharging direction (the direction of the arrow B). The spur roller is biased to the paper discharge roller 28 side while opposed thereto.

The recording paper P on which recording was made in the recording unit 7 is discharged with the recorded face turned upward to the paper discharge unit 10. The paper discharge unit 10 is arranged above the paper feed unit 11, and a paper discharge outlet 10*a* is open in common with the opening 2*a* of the front face of the housing 2. The recording paper P discharged from the paper discharge unit 10 following the paper discharging direction (the direction of the arrow B) are stacked and housed in a paper discharge tray 10*b* positioned on the inner side of the opening 2*a*.

In the meantime, an ink storage unit (not shown) is provided at the front right end position of the housing 2 covered with the image reading device 12. In the ink storage unit, four ink cartridges, respectively housing ink of four different colors (black (Bk), cyan (C), yellow (Y), magenta (M)) for full-color recording, are placed so as to be detachable in a state where the image reading device 12 is upwardly opened. The ink cartridges of the respective colors are connected to the foregoing recording head 4 with four ink supply tubes having flexibility. The ink housed in the respective ink cartridges are supplied to the recording head 4 through the respective ink supply tubes.

In the following, the paper feed cassette 3 is described in detail.

Figure 4:
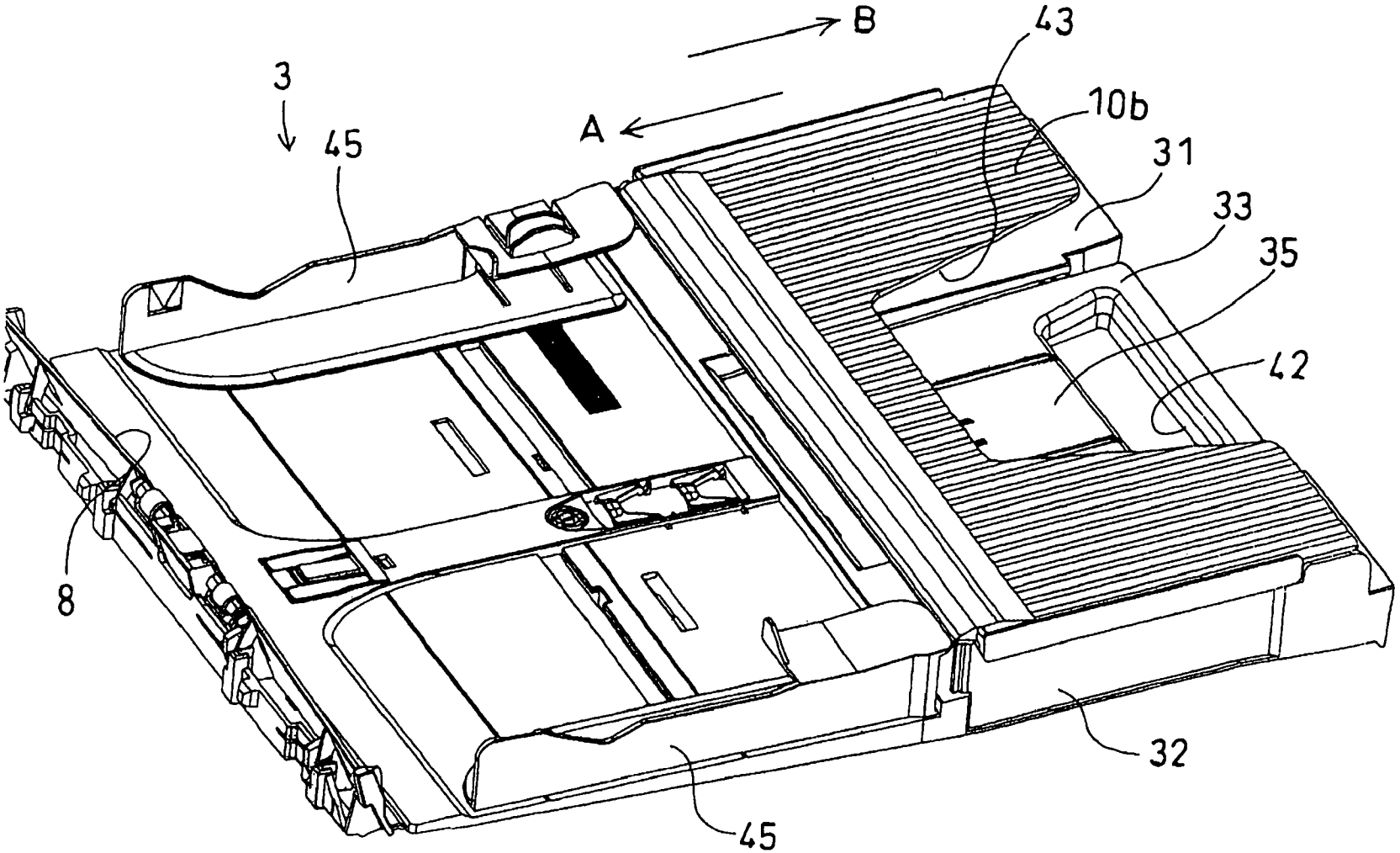
FIG. 4 is a perspective view of a paper feed cassette.
Figure 5:
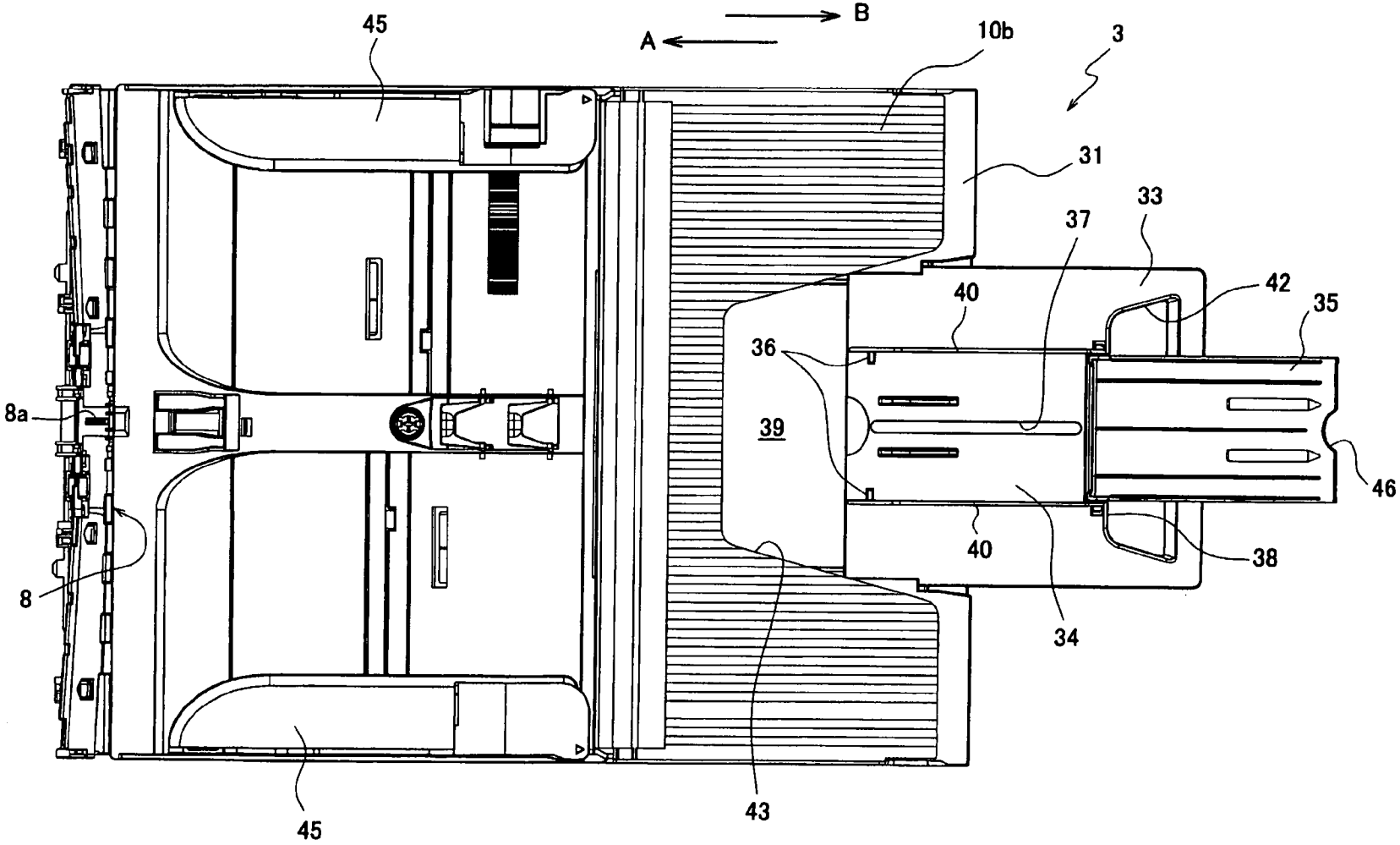
FIG. 5 is a plan view of the paper feed cassette.
Figure 6A:
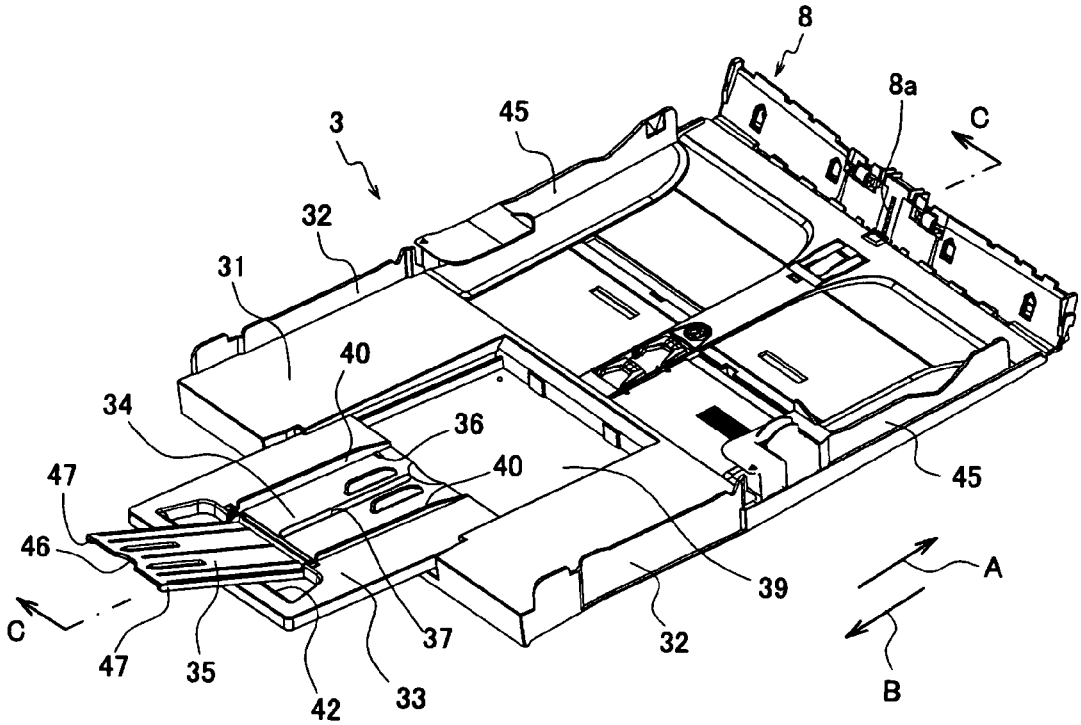
FIGS. 6A and 6B are perspective views of the paper feed cassette with a supplementary supporting member pulled out.
Figure 6B:
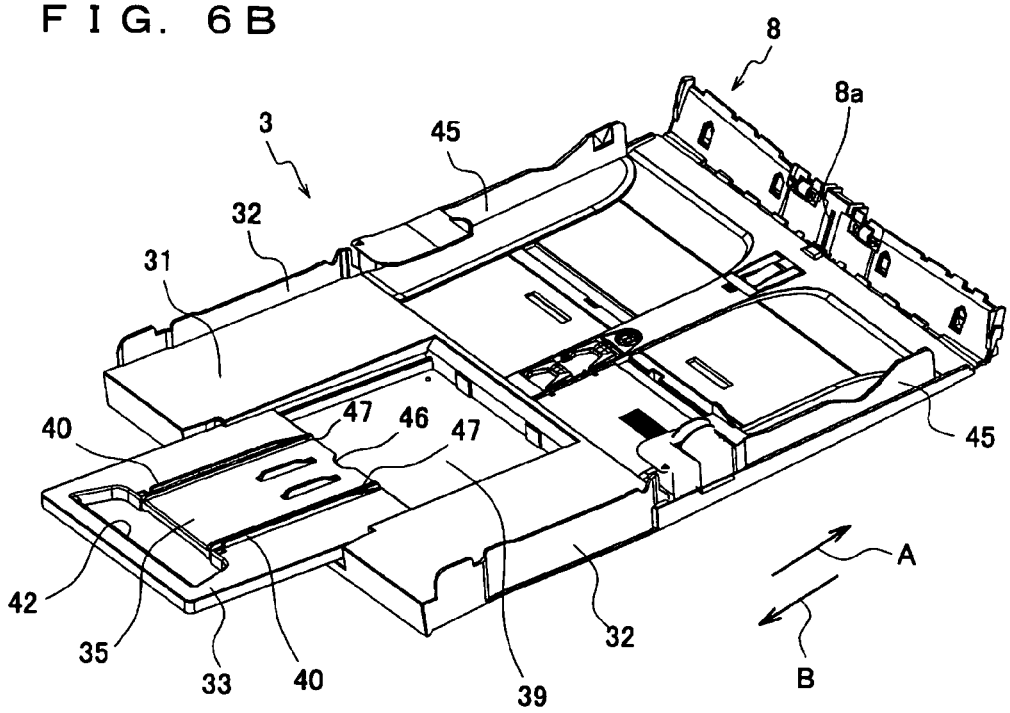
Figure 7A:
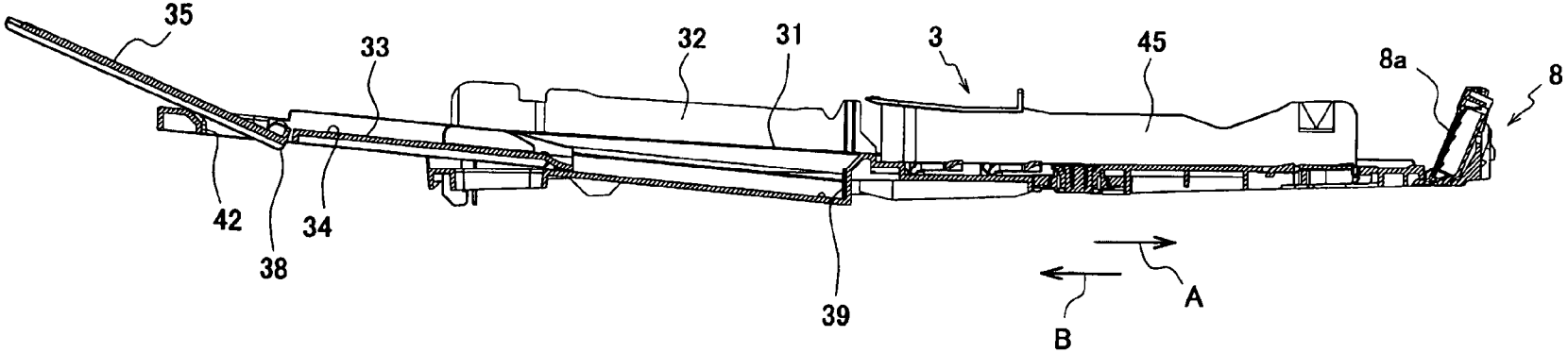
FIGS. 7A and 7B are side sectional views of the paper feed cassette.
Figure 7B:
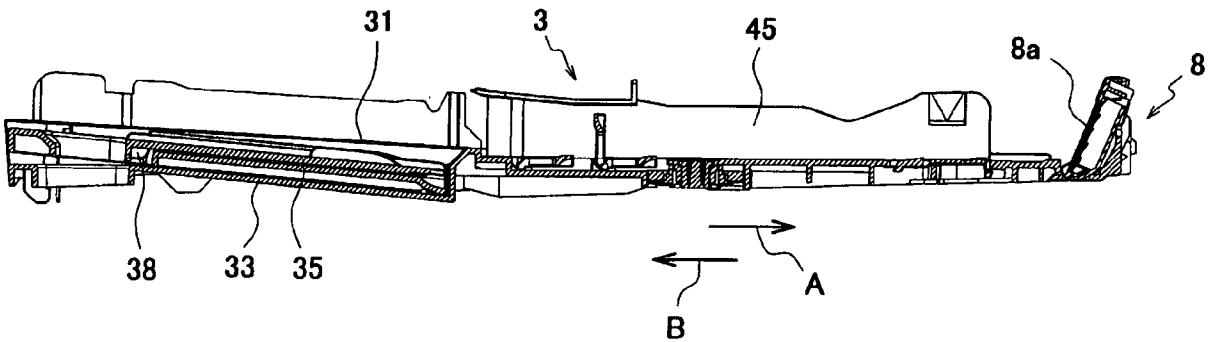

FIG. 4 is a perspective view of the paper feed cassette 3, and FIG. 5 is a plan view thereof. FIGS. 6A and 6B are perspective views of the paper feed cassette 3 with a later-described supplementary support member 33 pulled out. FIGS. 7A and 7B are side sectional views of the paper feed cassette 3. FIG. 7A is a sectional view taken at a line C-C in FIG. 6A.

As shown in FIGS. 4, 5, 6A, 6B, 7A and 7B, the paper feed cassette 3 is provided with a base plate 31 on which recording papers P are placed, wherein in the upstream side of the paper feed direction (the direction of the arrow A) in the base plate 31, side plates 32, 32 are installed to stand on both sides along the paper feed direction. Then, the paper discharge tray 10*b* on which recording papers P discharged from the recording unit 7 can be placed is detachably mounted across the both side plates 32, 32 so as to cover a part of the recording papers P placed on the base plate 31 in the upstream side in the paper feed direction (the direction of the arrow A). At the end in the downstream side of the discharging direction (the direction of the arrow B) of the paper discharge tray 10*b*, a notch 43 in a square shape with one side open as viewed from a plane is formed in the central part of the width direction so that refilling of recording papers P to the base plate 31 can be facilitated.

In addition, in the downstream side of the paper feed direction (the direction of the arrow A) in the base plate 31, a recording paper width guide 45 for setting the recording papers P in the center of the width direction of the paper feed cassette 3 symmetrically is movably provided so as to stretch or shrink in the horizontal direction (the width direction).

In addition, in the central part of the width direction at the end in the upstream side of the paper feed direction (the direction of the arrow A) of the base plate 31, the almost rectangular shaped supplementary support member 33 is provided so as to slide further outwardly (to further downstream side of the discharging direction) from the end in the upstream side of the paper feed direction. Then, on the base plate 31 is formed a first housing unit 39 that not only sidably sandwiches the both ends of the supplementary support member 33 along the paper feed direction (the direction of the arrow A), but also can house the supplementary support member 33 (see FIGS. 5, 6A and 6B).

In addition, in the supplementary support member 33 is formed a gripping opening 42 penetrating a plate surface at the end in the upstream side of the paper feed direction (the direction of the arrow A) so that a user can easily grip the supplementary support member 33 when sliding it.

In addition, a supplementary paper discharge tray 35 (corresponding to the supplementary conveyed object receiving unit and a supplementary sheet receiving tray) is attached to the supplementary support member 33. The supplementary paper discharge tray 35 is designed to enlarge (extend) the recording paper receiving unit (corresponding to the conveyed object receiving means and a sheet receiving tray) having the paper discharge tray 10*b* in the discharging direction (the direction of the arrow B) of recording papers P (see FIG. 2.).

In other words, a second housing unit 34 as a depression for housing the supplementary paper discharge tray 35 is formed on the top face of the supplementary support member 33. Then, the supplementary paper discharge tray 35 is configured to be rotatable between a housed position where it is housed in the second housing unit 34 (see FIGS. 4, 6B and 7B) and an extended position (see FIGS. 2, 5, 6A and 7A) extending more in the discharging direction (the direction of the arrow B) from the end in the upstream side of the paper feed direction (the direction of the arrow A) of the base plate 31, and the supplementary paper discharge tray 35 supports recording papers P projecting outward when the supplementary paper discharge tray 35 is in the extended position. In other words, setting the supplementary paper discharge tray 35 as the housed position puts the recording paper receiving unit into the reference state in which the recording paper receiving unit is only formed of the paper discharge tray 10*b*, while setting the supplementary paper discharge tray 35 as the extended position puts the recording paper receiving unit into the extended state in which the recording paper receiving unit is formed of the paper discharge tray 10*b* and the supplementary paper discharge tray 35. Thus, the recording paper receiving unit is configured so as to change the state of the recording paper receiving unit by changing a position of the supplementary paper discharge tray 35.

In addition, ribs 36, 36 slightly projecting upward are formed on the base of the second housing unit 34 (see FIGS. 5 and 6), and ribs 40, 40 provided on both ends of the second housing unit 34 and ribs 47, 47 provided on both ends of the supplementary paper discharge tray 35 are configured to be coplanar by abutting on the lower face of the supplementary paper discharge tray 35 with the supplementary paper discharge tray 35 housed (see FIG. 6B).

On the one hand, as the supplementary paper discharge tray 35 abuts on the inner side in the upstream side of the discharging direction (the direction of the arrow A) in the gripping opening 42 of the supplementary support member 33, in the extended state, the supplementary paper discharge tray 35 is kept in an inclined state in which the downstream side of the discharging direction (the direction of the arrow B) is higher than the upstream side (see FIGS. 2, 6A and 7A). The inclined state makes it easier to receive an edge of the recording papers P projecting from the paper discharge tray 10*b* located in the upper side. Furthermore, the inner side of the gripping opening 42 is used to retain the supplementary paper discharge tray 35 in the inclined state, which eliminates the need for adding a special structure to maintain the inclined state. In addition, at the end on the farther side from the pivot 38 (see FIGS. 5, 7A and 7B) that serves as a pivot of the supplementary paper discharge tray 35, a notch for rotation 46 is provided to make it easier to grip the supplementary paper discharge tray 35 when it is to be rotated.

The multi-functional device 1 of the present embodiment is also such configured that a position of the supplementary paper discharge tray 35 can be detected.

Figure 8A:
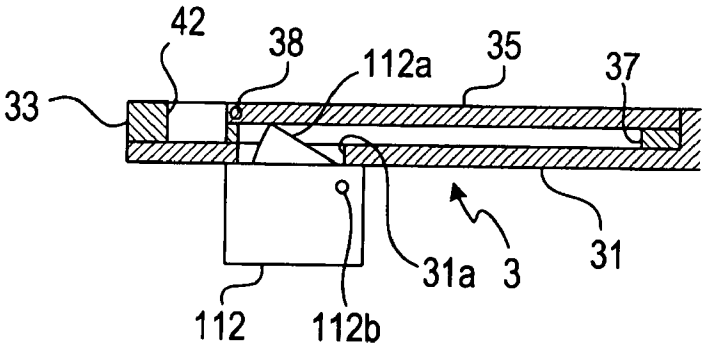
FIGS. 8A, 8B and 8C are explanatory views for explaining the configuration that detects a position of a supplementary paper discharge tray.
Figure 8B:
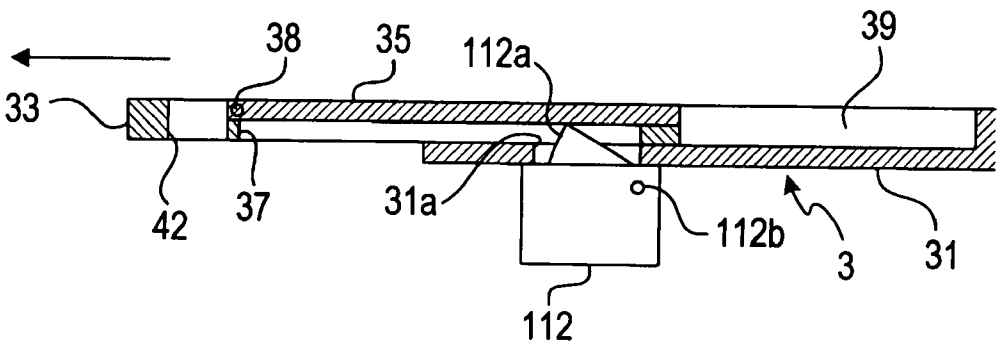
Figure 8C:
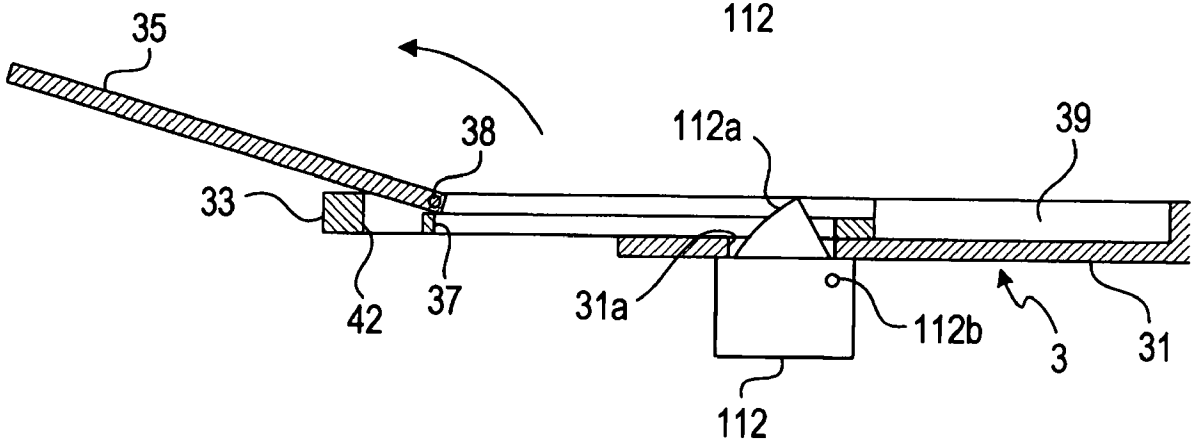

FIGS. 8A, 8B and 8C are explanatory views that explain the configuration for detecting the position of the supplementary paper discharge tray 35. To be specific, FIG. 8A is a schematic sectional view of the paper feed cassette 3 with the supplementary support member 33 and the supplementary paper discharge tray 35 housed. FIG. 8B is a schematic sectional view of the paper feed cassette 3 with the supplementary support member 33 pulled out from the state of FIG. 8A. FIG. 8C is a schematic sectional view of the paper feed cassette 3 with the supplementary paper discharge tray 35 rotationally moved to the extended position from the state of FIG. 8B.

As shown in FIGS. 8A, 8B and 8C, a supplementary tray sensor (switch) 112 for detecting a position of the supplementary paper discharge tray 35 is provided in the lower part of the paper feed cassette 3. The supplementary tray sensor 112 includes a plate-like projecting strip 112*a* that can be swung around the pivot 112*b* extending in the main-scanning direction, and is configured to turn ON when the projecting strip 112*a* is pushed in the main body side of the supplementary tray sensor 112 (the underside in FIGS. 8A, 8B, and 8C) and turn OFF when the projecting strip 112*a* is not pushed in.

On the one hand, a through-hole 31*a* in the shape of a long hole is provided on the base plate 31 of the paper feed cassette 3, and a linear through hole 37 (see FIGS. 5 and 6A) along the pullout direction of the supplementary support material 33 is provided in the supplementary supply material 33. The through-hole 31*a* of the base plate 31 and the through-hole 37 of the supplementary support member 33 are configured to communicate irrespective of the pullout position of the supplementary support member 33. Then, the projecting strip 112*a* of the supplementary tray sensor 112 is designed to directly contact the supplementary paper discharge tray 35 with the through-hole 31*a* and the through-hole 37 penetrating. With such the configuration, in the state in which the supplementary paper discharge tray 35 is in the housed position (see FIGS. 8A and 8B), the projecting strip 112*a* is pushed into the main body side of the supplementary tray sensor 112 by the supplementary paper discharge tray 35, and the supplementary tray sensor 112 is turned ON. At the same time, in the state in which the supplementary paper discharge tray 35 is in the extended position (FIG. 8C), the supplementary tray sensor 112 is turned OFF because the projecting strip 112*a* is not pushed in by the supplementary paper discharge tray 35. This enables the present multi-functional device 1 to determine a position of the supplementary paper discharge tray 35 (in other words, state of the recording paper receiving unit) based on the detection result by the supplementary tray sensor 112.

In addition, the projecting strip 112*a* is configured so as to be moved to a position where the projecting strip 112*a* is completely housed in the main body side of the supplementary tray sensor 112 by being pushed to the main body of the supplementary tray sensor 112. This enables the projecting strip 112*a* to be pushed into the main body of the supplementary tray sensor 112 and housed therein when the paper feed cassette 3 is attached or removed, resulting in no interference with the attachment or removal.

In the following, the configuration of the control system of the multi-functional device 1 of the present embodiment is described.

Figure 9:
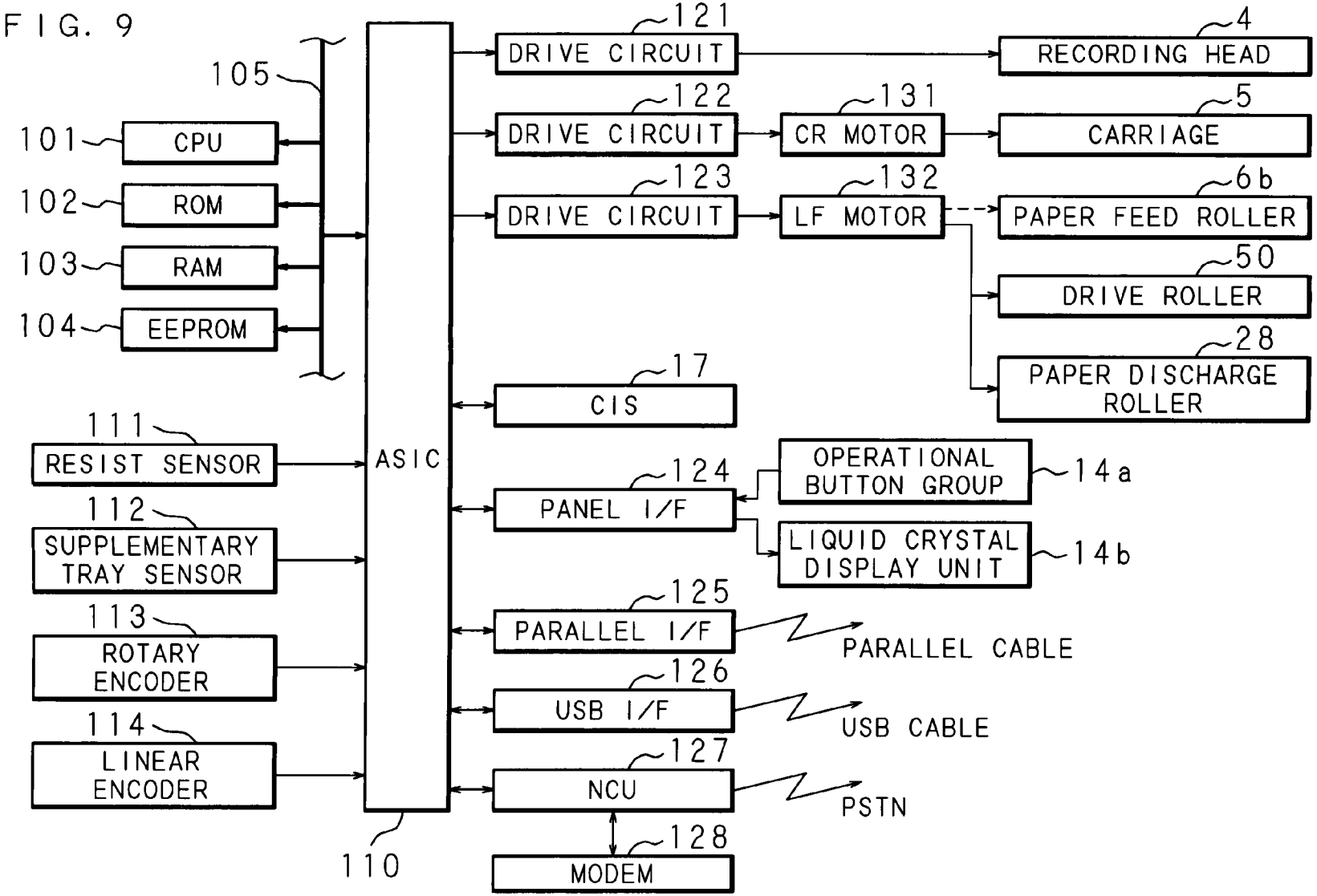
FIG. 9 is a block view showing configuration of the control system of the multi-functional device.

FIG. 9 is a block diagram showing the configuration of the control system of the multi-functional device 1. As shown in FIG. 9, the control system is mainly composed of a microcomputer comprising CPU 101, ROM 102, RAM 103, EEPROM 104 and a bus 105 for connecting them. In addition, the bus 105 is connected to ASIC (Application Specific Integrated Circuit) 110 for not only taking in information from various sensors and processing it rapidly, but also driving and controlling various actuators.

Then, To the ASIC 110 connected are a resist sensor 111 for detecting a position to which the recording paper P has been fed, a supplementary tray sensor 112 for detecting a position of a supplementary paper discharge tray 35, a rotary encoder 113 for detecting amount of rotations of a drive roller 50, and a linear encoder 114 for detecting shifting amount of a carriage 5.

Also, to the ASIC 110 are connected a drive circuit 121 for selectively ejecting ink from the recording head 4 onto recording papers P at predetermined timing, a drive circuit 122 for moving the carriage 5 provided with the recording head 4 in the main-scanning direction (the horizontal direction) by driving the CR motor 131, and a drive circuit 123 for conveying recording papers P by driving the LF motor 132 that serves as a drive source for rotationally driving the paper feed roller 6*b*, the drive roller 50 and the paper discharge roller 28 described above.

Now, the paper feed roller 6*b*, the drive roller 50, and the paper discharge roller 28 rotate concurrently when rotation driving force from the LF motor 132 is transmitted. However, when the paper feed roller 6*b* is rotating in the direction of feeding recording papers P from the paper feed cassette 3, the drive roller 50 and the paper discharge roller 28 are configured to rotate in the direction opposite to the direction of conveying recording papers P to the paper discharging side (hereinafter referred to the "conveyance rotation direction"). In addition, the drive roller 50 and the paper discharge roller 28 are configured to rotate in the conveyance rotation direction when rotation direction of the LF motor 132 is reversed. In other words, in the state in which recording papers P are fed from the paper feed cassette 3 by means of rotating paper feed roller 6*b*, the drive roller 50 is rotating in the direction opposite to the conveyance rotation direction, whereby the front edge of the recording paper P fed from the paper feed cassette 3 abuts on the conveyance (resist) roller comprised of the drive roller 50 and the nip roller 51, to correct the inclination of the recording paper P. In addition, a rotation driving force transmission path from the LF motor 132 to the paper feed roller 6*b* is configured so as to switch the transmission state in which the rotation driving force is transmitted and the non-transmission state in which the rotation driving force is not transmitted. The rotation driving force is transmitted from the LF motor 132 to the paper feed roller 6*b*, only when the paper feed operation of the recording papers P takes place.

At the same time, the contact image sensor (CIS) 17 described above is connected to the ASIC 110, wherein image data of documents read by the contact image sensor 17 is input.

In addition, to the ASIC 110 is a panel interface (panel I/F) 124 for inputting into the ASIC 110 information that a user enters through input operation with the operational button group 14*a* of the operational panel unit 14 and displaying various messages, etc., to the liquid crystal display unit 14*b* of the operational panel unit 14 according to a display command from the ASIC 110.

In addition, to the ASIC 110 are connected external equipment such as a personal computer (now shown), a parallel interface (parallel I/F) 125 for communication through a parallel cable or USB cable, or an NCU (Network Control Unit) 127 for communication through an USB interface (USB I/F) 126 and PSTN (Public Switched Telephone Network), etc. In addition, to the NCU 127 is connected a modem 128 for not only demodulating a communication signal inputted from PSTN to NCU 127 but also modulating into a communication signal data to be transmitted to the external from NCU 127 by means of facsimile transmission, etc.

In the multi-functional device 1 of the present embodiment being thus configured, operations of the CPU 101 and the ASIC 110 implement the printer function, the copy function, the scanner function and the facsimile function.

For example, in the printer function, the copy function, and the facsimile function, if images are recorded on recording papers P, the paper feed roller 6*b* is first turned by driving the LF motor 132, and the recording papers P are fed from the paper feed cassette 3. The drive roller 50 and the paper discharge roller 28 are rotating in the reverse direction to the conveyance rotation direction. Thus, even when the front edge of the recording papers P conveyed by the paper feed roller 6*b* abuts on the conveyance (resist) roller comprised of the drive roller 50 and the nip roller 51, the inclination thereof is corrected. Then, the recording papers P are fed to the recording unit 7 by placing the rotation driving force transmission path from the LF motor 132 to the paper feed roller 6*b* into non-transmission state, thereby stopping the rotation of the paper feed roller 6*b*, and then switching the rotation of LF motor 132 to a reverse direction and having the drive roller 50 and the paper discharge roller 28 rotate in the conveyance rotation direction. Images represented by image data are recorded by alternately repeating the operation of ejecting ink from the recording head 4 to the recording papers P fed to the recording unit 7 while moving the carriage 5 provided with the recording head 4 in the main-scanning direction (the horizontal direction) and the operation of conveying a predetermined amount of recording papers P. Then, when recording of images on the recording papers P is complete, rotation of the paper discharge roller 28 discharges the recording papers P into the paper discharge tray 10*b*.

In view of reduction of time needed for the recording process of recording images onto the recording papers P, it is preferable to set the conveyance speed (discharge speed) of the recording papers P as high-speed as possible when the recording papers P are discharged into the paper discharge tray 10*b* by the paper discharge roller 28. However, there is a tendency that the faster the discharge speed of the recording papers P is set, the worse alignment performance of recording papers P discharged into the paper discharge tray 10*b* is. Thus, there could arise the problem that recording papers P might drop from the paper discharge tray 10*b*. Hence, in a conventional printer of this type, the state in which the supplementary paper discharge tray 35 is in the housed position is regarded as a reference, and the discharge speed of the recording papers P is set lower based on the state of the housed position. However, discharge of recording papers P at a low discharge speed even when the supplementary paper discharge tray 35 is in the extended position would contribute to longer time of the recording process of recording images onto the recording papers P.

Thus, the multi-functional device 1 of the present embodiment aims to reduce the time needed for the process of recording images onto the recording papers P, while preventing the recording papers P from dropping from the paper discharge tray 10*b*, by changing the discharge speed of the recording papers P according to a position of the supplementary paper discharge tray 35.

Figure 10:
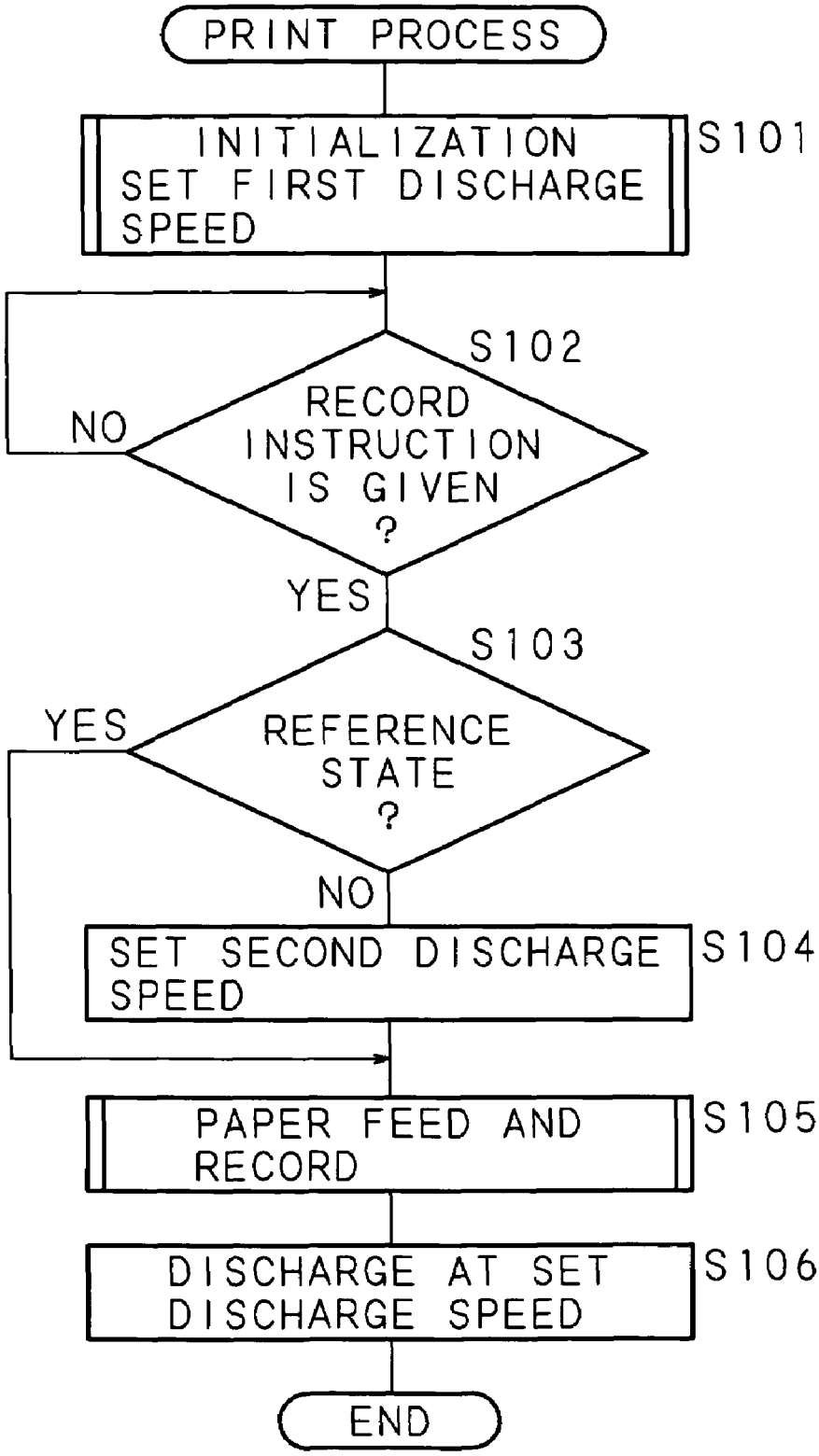
FIG. 10 is a flow chart of a print process of the embodiment.

In the following, the print process to be performed by the CPU 101 of the multi-functional device 1 in order to implement such a control is described with reference to a flow chart of FIG. 10.

When the print process is started, initialization first takes place at S101, and the discharge speed of recording papers P by the paper discharge roller 28 is set to a first discharge speed. A first discharge speed used herein is the discharge speed set based on the case that the supplementary paper discharge tray 35 is in the housed position (i.e., the recording paper receiving unit is in a reference state).

Then, at S102, it is determined whether or not a record instruction was given for starting the process of recording images onto the recording papers P. The record instruction is entered by the record start operation at a personal computer, the document copy start operation at the operational panel unit 14, reception of facsimile data, etc.

Next, at S103, it is determined based on the detection result by the supplementary tray sensor 112 whether or not the recording paper receiving unit is in the reference state.

If it is determined at S103 that the recording paper receiving unit is not in the reference state (being in the extended state), the process moves to S104 where the discharge speed of recording papers P by the paper discharge roller 28 is set to second discharge speed. After this, the process shifts to S105. Here, the second discharge speed is discharge speed set based on the case in which the supplementary paper discharge tray 35 is in the extended position (the case in which the recording paper receiving unit is in the extended state), and is faster than the first discharge speed.

If it is determined at S103 that the recording paper receiving unit is in the reference state, the process moves straight to S105. In fact, the discharge speed remains set to the first discharge speed.

At S105, the paper feed operation of the recording papers P and the record operation of recording images onto the recording papers P take place.

Finally, at S106 the discharge operation of the recording papers P is performed at the set discharge speed, the print process ends. In other words, if the supplementary paper discharge tray 35 is in the housed position (if the recording paper receiving unit is in the reference state), the recording papers P are discharged at the first discharge speed, while the recording papers P are discharged at a second discharge speed that is faster than the first discharge speed, if the supplementary paper discharge tray 35 is in the extended position (if the recording paper receiving unit is in the extended state).

As described above, the multi-functional device 1 of the present embodiment sets the discharge speed of the recording papers P faster compared with the reference state, if the recording paper receiving unit is in the extended state. This enables the multi-functional device 1 to reduce time needed for the discharge operation of the recording papers P while preventing the recording paper P from dropping from the paper discharge tray 10*b*. The multi-functional device 1 can effectively prevent the recording papers P from falling from the paper discharge tray 10*b* because the recording paper receiving unit having the paper discharge tray 10*b* is enlarged (extended) in the discharging direction (the direction of the arrow B) of the recording papers P by the supplementary paper discharge tray 35. In particular, in one having the facsimile function like the present multi-functional device 1, as dropping of the recording paper P from the paper discharge tray 10*b* might lead to any trouble due to missing recording paper P, it is highly effective to prevent the recording papers P from dropping.

In addition, as the present multi-functional device 1 determines whether or not the supplementary paper discharge tray 35 is in the extended position, based on the detection result by the supplementary tray sensor 112, the state of the supplementary paper discharge tray 35 can be determined more accurately than the configuration that makes a determination based on information inputted by a user through input operation.

Furthermore, as the printer function of the present multi-functional device 1 is an ink jet type (i.e., the present multi-functional device 1 is also an ink jet printer), time needed for the process of recording images onto recording papers P can be reduced effectively, by reducing the time needed for the discharge operation of the recording papers P. Thus, this is highly effective in the environment where images are recorded on a large quantity of the recording papers P (e.g., business environment), in particular.

In addition, in present multi-functional device 1, in the state the paper feed roller 6*b* is rotating in the direction of feeding recording papers P from the paper feed cassette 3, because of the structure thereof, the paper discharge roller 28 rotates in the reverse direction to the conveyance rotation direction. Thus, if the discharge speed is not sufficient, the back end of the recording papers P that should have been discharged remains in contact with the paper discharge roller 28. As, following the discharge operation, the paper discharge roller 28 rotates in the reverse direction to the conveyance rotation direction in the paper feed operation of the recording papers P, the recording papers P may be drawn by the paper discharge roller 28 (reverse conveyance), thereby leading to occurrence of a jam. However, the present multi-functional device 1 can make it difficult for such the problem to occur.

In the multi-functional device 1 of the above embodiment, the paper discharge roller 28 corresponds to discharging means, the paper discharge tray 10*b* and the supplementary paper discharge tray 35 correspond to the conveyed object receiving means and a sheet receiving tray, the supplementary tray sensor 112 corresponds to detection means and a detector, and the processes of S103 and S104 in the print process (FIG. 10) correspond to discharge speed control means.

Although one embodiment has been described so far, it is needless to say that a variety of forms can be adopted.

For instance, although the multi-functional device 1 of the above embodiment determines whether or not the supplementary paper discharge tray 35 is in the extended position, based on the detection result by the supplementary tray sensor 112 configured to detect the position of the supplementary paper discharge tray 35 depending on how the supplementary tray sensor 112 is in contact with the supplementary paper discharge tray 35, it is not limited to this, and known sensors such as an optical sensor that detects the position of the supplementary paper discharge tray 35 without contact may be utilized.

It is also possible to determine whether or not the supplementary paper discharge tray 35 is in the extended state without using such sensors. For example, the configuration is possible in which a user himself/herself enters by the input operation with the operational button group 14*a* of the operational panel unit 14 (corresponding to the input means) whether or not he/she is using the supplementary paper discharge tray 35 in the extended position. Such the configuration makes it possible to achieve the effect similar to the multi-functional device 1 of the above embodiment even without a sensor, by performing the determining process on whether the supplementary paper discharge tray 35 is in the extended position, based on the information on the state of the recording paper receiving unit that a user enters through the input operation, instead of the determining process on whether the supplementary paper discharge tray 35 is in the extended position, based on the detection result by the supplementary tray sensor 112 at S103 in the print process (FIG. 10). The input operation by the user is not limited to use of the operational button group 14*a* of the operational panel unit 14, and a user may perform the input operation by means of a personal computer.

On the other hand, although the multi-functional device 1 of the above embodiment is such configured that the supplementary paper discharge tray 35 rotationally moves between the housed position and the extended position, the equipment is not limited to such the configuration and may be configured to have the supplementary paper discharge tray move slidingly. In addition, although the multi-functional device 1 of the above embodiment adopts the configuration in which the supplementary paper discharge tray 35 is provided in the supplementary support member 33 of the paper feed cassette 3, thus having a positional relation in which the supplementary paper discharge tray 35 and the paper discharge tray 10*b* do not contact each other, the configuration is not limited to this, and, for example, the supplementary paper discharge tray and the paper discharge tray may be integrally configured, wherein the recording paper receiving unit may be extended by pulling the supplementary paper discharge tray from the paper discharge tray, etc.

Figure 11A:
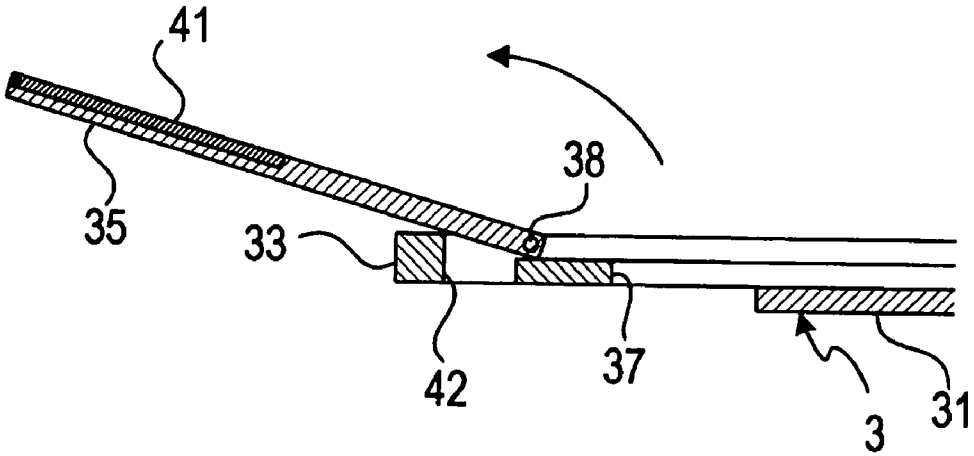
FIGS. 11A and 11B are explanatory views of a variant example in which a recording paper receiving unit is configured so as to be changed to extended states of a plurality of phases.
Figure 11B:
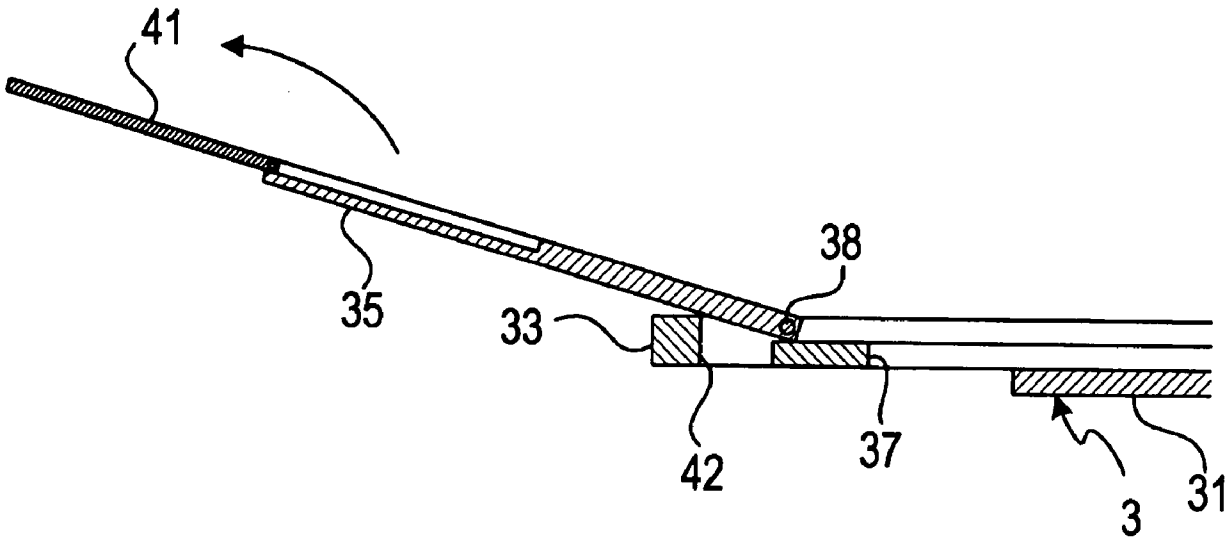

In addition, the multi-functional device 1 of the above embodiment is such configured that the recording paper receiving unit can be switched between the reference state and the extended state by positioning the supplementary paper discharge tray 35 in either the housed position or the extended position, it is not limited to this configuration, and may be such configured that the recording paper receiving unit can be changed to the extended states of a plurality of phases that differs in the degree of extension to the reference state. For example, as shown in FIGS. 11A and 11B, provision of the supplementary member 41 whereby the supplementary paper discharge tray 35 can be further extended in the discharging direction of the recording papers P allows the extension state of the recording paper receiving unit to be changed to a first extended state (FIG. 11A) and a second extended state (FIG. 11B) in which it is more extended than the first extended state.

Figure 12:
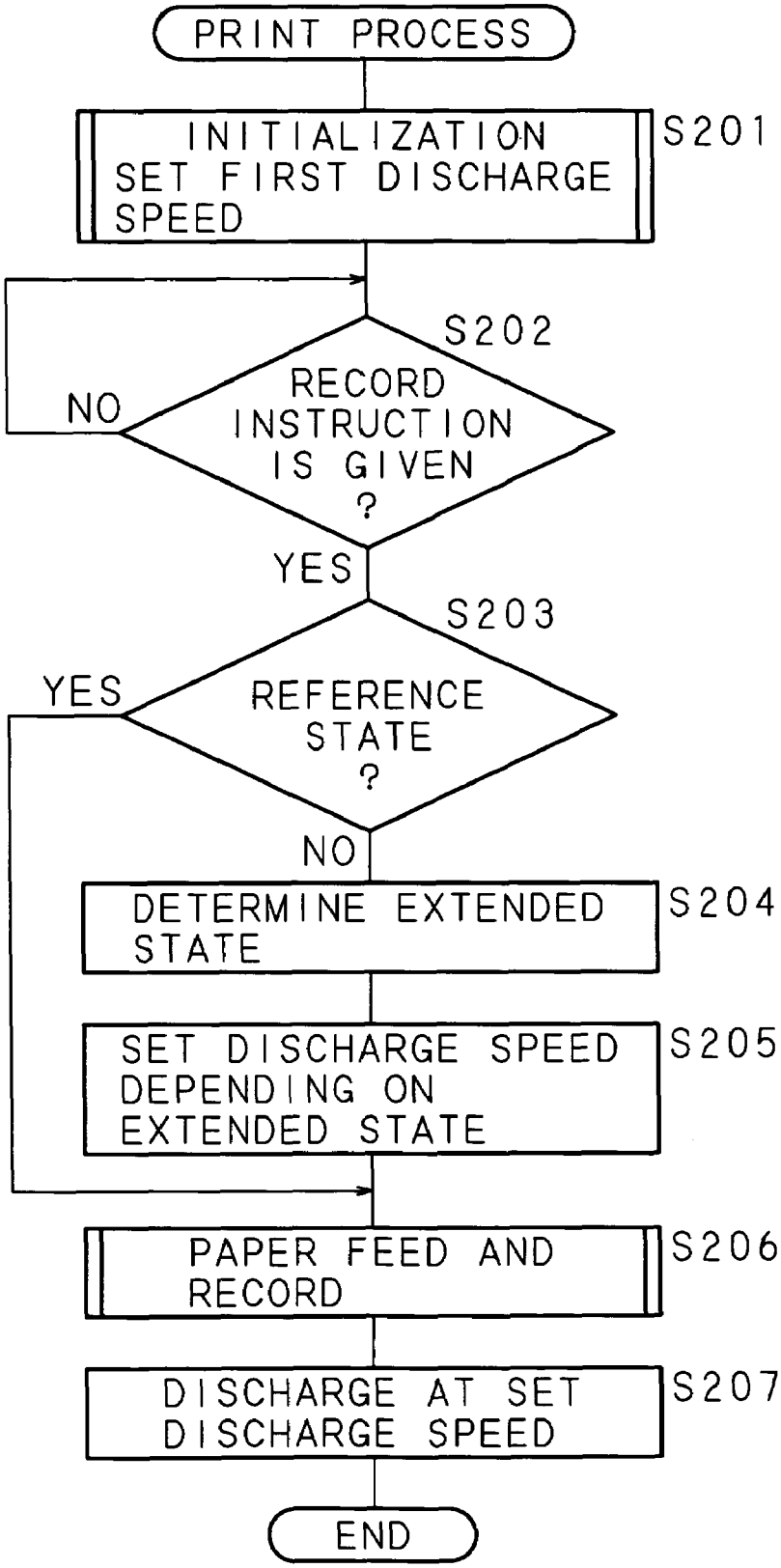
FIG. 12 is a flow chart of the print process of the variant example.

The following describes a preferred example of the print process in such the configurations with reference to a flow chart of FIG. 12. Although the process of determining the state of the recording paper receiving unit based on information entered by a user through the input operation is exemplified, it is also possible to use the process of determining the state of the recording paper receiving unit based on the detection result by sensors, etc.

When the print process is started, initialization first takes place at S201, and then the discharge speed of recording papers P by the paper discharge roller 28 is set to the first discharge speed. The first discharge speed is discharge speed set based on the case in which the recording paper receiving unit is in a reference state.

Then, it is determined at S202 whether or not a record instruction for starting the record process of images onto recording papers P was given. The record instruction is entered by, for instance, the record start operation at a personal computer, the document copy start operation on the operational panel unit 14, reception of facsimile data, etc.

Then, it is determined at S203, based on information on the state of the recording paper receiving unit that a user entered through the input operation, whether the recording paper receiving unit is in the reference state.

If it is determined at S203 that the recording paper receiving unit is not in the reference state, the process moves to S204 where it is determined whether the extended state of the recording paper receiving unit is in the first extended state or the second extended state. Then, at S205 the discharge speed of the recording papers P by the paper discharge roller 28 is set to the discharge speed depending on the extended state of the recording paper receiving unit determined at S204, the process moves to S206. To be specific, if the extended state of the recording paper receiving unit is in the first extended state, the paper discharge roller 28 is set to the second discharge speed that is faster than the first discharge speed. If the extended state of the recording paper receiving unit is in the second extended state, it is set to the third discharge speed that is faster than the second discharge speed.

At the same time if it is determined at S203 that the recording receiving unit is in the reference state, the process moves straight to S206. In fact, the discharge speed remains set to the first discharge speed.

At S206 the paper feed operation of recording papers P and the record operation of images onto the recording papers P take place.

Finally, at S207 the discharge operation of the recording papers P is performed at the set discharge speed, the print process ends. In fact, the larger the degree of extension of the recording paper receiving unit is, the faster discharge of the recording papers P is performed. Thus, the time needed for the discharge operation of the recording papers P (and thus, the time needed for the process of recording images onto the recording papers P) can be effectively reduced.

On the one hand, although the above embodiment exemplifies the multi-functional device 1 such configured that the paper discharge tray 10*b* is provided in the paper feed cassette 3, it is needless to say that the multi-functional device is also applicable to the configuration in which the paper feed cassette (paper feed tray) and the paper discharge tray are provided in different locations.

As this description may be embodied in several forms without departing from the sprit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. A discharging device, comprising:

a discharge unit configured to convey an object;

a receiving unit configured to receive the object from the discharge unit and selectively move between a first state and a second state; and a control unit configured to determine whether the receiving unit is in one of the first state and the second state, to control the discharge unit to convey the object to the receiving unit at a first discharge speed greater than zero centimeters per second when the receiving unit is in the first state, and to control the discharge unit to convey the object to the receiving unit at a second discharge speed greater than the first discharge speed when the receiving unit is in the second state.

2. The discharging device according to claim 1, wherein the receiving unit extends in an object discharging direction at least when the receiving unit is in the second state.

3. The discharging device according to claim 1, further comprising a detection unit configured to detect whether the receiving unit is in one of the first state and the second state, wherein said control unit is configured to determine whether the receiving unit is in one of the first state and the second state based on a detection result by said detection unit.

4. The discharging device according to claim 1, further comprising an input unit configured to receive information associated with whether the receiving unit is in one of the first state and the second state, wherein said control unit is configured to determine whether the receiving unit is in one of the first state and the second state based on the information.

5. The discharging device according to claim 1, wherein said first state comprises a first extended state and said second state comprises a second extended state, and said receiving unit is further extended in said second extended state than in said first extended state.

6. The discharging device according to claim 1, wherein the conveyed object comprises a sheet, the receiving unit comprises a sheet receiving tray, and the control unit comprises a discharge speed controller.

7. An ink jet printer, comprising:

said discharging device according to claim 6, wherein said discharging device is configured so as to discharge a recording medium in which images are recorded, as the sheet.

8. The discharging device according to claim 1, wherein the receiving unit comprises a supplementary object receiving portion configured to receive the sheet, wherein when the receiving unit is in the first state the supplementary object receiving portion is in a first position, and when the receiving unit is in the second state the supplementary object receiving portion is in a second position.

9. The discharge device according to claim 8, wherein said first position comprises a housed position and said second position comprises an extended position.

10. An ink jet printer, comprising:

said discharging device according to claim 1, wherein said discharging device is configured so as to discharge a recording medium in which images are recorded, as the conveyed object.

11. The discharge device according to claim 1, wherein said second state comprises an extended state.

12. A discharging device, comprising:

a conveyed object receiving unit having a supplementary conveyed object receiving part, on which a conveyed object can be placed, and being configured so as to be changed to an extended state that said supplementary conveyed object receiving part is extended;

a discharge unit for discharging a conveyed object which has been conveyed, to said conveyed object receiving unit; and a controller capable of performing operations of:

determining the state of said conveyed object receiving unit; and accelerating a discharge speed of the conveyed object discharged by said discharge unit if the state of said conveyed object receiving unit is in the extended state, wherein said conveyed object receiving unit is configured to move between different extended states each having a different degree of extension, and said controller is further capable of performing an operation of accelerating the discharge speed of the conveyed object discharged by said discharge unit as the degree of extension of said conveyed object receiving unit becomes larger.

13. A discharging device, comprising:

conveyed object receiving means having a supplementary conveyed object receiving unit, on which a conveyed object can be placed, and being configured so as to be changed to an extended state that said supplementary conveyed object receiving unit is extended;

discharging means for discharging a conveyed object which has been conveyed, to said conveyed object receiving means; and discharge speed control means for determining the state of said conveyed object receiving means, and accelerating the discharge speed of the conveyed object discharged by said discharging means if said conveyed object receiving means is in the extended state, wherein said conveyed object receiving means is configured to move between different extended states each having a different degree of extension, said discharge speed control means accelerates the discharge speed of the conveyed object discharged by said discharging means as the degree of extension of said conveyed object receiving means becomes larger.

* * * * *